US011458058B2

(12) United States Patent
Fischer

(10) Patent No.: US 11,458,058 B2
(45) Date of Patent: Oct. 4, 2022

(54) SUPPORT SYSTEM FOR MOUNTING A MEDICAL DEVICE

(71) Applicant: Ondal Medical Systems GmbH, Hunfeld (DE)

(72) Inventor: Udo Fischer, Schonungen (DE)

(73) Assignee: Ondal Medical Systems GmbH, Hunfeld (DE)

( * ) Notice: Subject to any disclaimer, the term of this patent is extended or adjusted under 35 U.S.C. 154(b) by 29 days.

(21) Appl. No.: 16/642,227

(22) PCT Filed: Sep. 3, 2018

(86) PCT No.: PCT/EP2018/073634
§ 371 (c)(1),
(2) Date: Feb. 26, 2020

(87) PCT Pub. No.: WO2019/043230
PCT Pub. Date: Mar. 7, 2019

(65) Prior Publication Data

US 2020/0352806 A1 Nov. 12, 2020

(30) Foreign Application Priority Data

Sep. 1, 2017 (EP) ..... 17001476

(51) Int. Cl.
*A61G 13/10* (2006.01)

(52) U.S. Cl.
CPC ..... *A61G 13/101* (2013.01); *A61G 2203/78* (2013.01)

(58) Field of Classification Search
CPC .. A61G 13/10; A61G 13/101; A61G 2203/72; A61G 2203/78
See application file for complete search history.

(56) References Cited

U.S. PATENT DOCUMENTS

| | | | | |
|---|---|---|---|---|
| 1,220,266 | A | 3/1917 | Ott | |
| 5,284,313 | A | 2/1994 | Hallgren | |
| 5,326,059 | A * | 7/1994 | Pryor | F16M 11/08 248/230.6 |
| 5,687,945 | A | 11/1997 | Lee | |
| 6,209,835 | B1 | 4/2001 | Walrath et al. | |
| 6,220,556 | B1 * | 4/2001 | Sohrt | F16C 11/106 248/278.1 |
| 6,471,167 | B1 * | 10/2002 | Myers | A61G 13/101 248/125.9 |
| D494,183 | S | 8/2004 | Wills et al. | |

(Continued)

FOREIGN PATENT DOCUMENTS

| | | | |
|---|---|---|---|
| CN | 106051392 | A | 10/2016 |
| WO | 2011/154703 | A2 | 12/2011 |
| WO | 2015106232 | A1 | 7/2015 |

OTHER PUBLICATIONS

International Search Report dated Nov. 29, 2018; International Application No. PCT/EP2018/073634.

*Primary Examiner* — Fredrick C Conley
(74) *Attorney, Agent, or Firm* — Dinsmore & Shohl LLP

(57) ABSTRACT

A support system for mounting a medical-technical device, comprises a fixation unit, a support module that is attachable to fixation unit, a support arm that comprises a mounting end and an attachment end, wherein the mounting end is mountable to support module; and a joint member that is attachable to attachment end of support arm.

15 Claims, 3 Drawing Sheets

(56) References Cited

U.S. PATENT DOCUMENTS

| | | | | |
|---|---|---|---|---|
| 6,896,231 | B1 | 5/2005 | Sullivan, Sr. | |
| 9,133,982 | B1 | 9/2015 | Valdez | |
| 2002/0011544 | A1 | 1/2002 | Bosson | |
| 2005/0006542 | A1 | 1/2005 | Henning et al. | |
| 2005/0121578 | A1 | 6/2005 | Asamarai et al. | |
| 2006/0278785 | A1* | 12/2006 | Wiesner ..... | F16M 13/022 248/231.71 |
| 2011/0260017 | A1 | 10/2011 | Monsalve et al. | |
| 2012/0318278 | A1 | 12/2012 | Aboujaoude et al. | |
| 2013/0112828 | A1 | 5/2013 | Sapper et al. | |
| 2013/0161466 | A1 | 6/2013 | Lau et al. | |

* cited by examiner

SUPPORT SYSTEM FOR MOUNTING A MEDICAL DEVICE

CROSS-REFERENCE TO RELATED APPLICATIONS

This application is the U.S. national stage of PCT/EP2018/073634 filed Sep. 3, 2018, which claims priority of European Patent Application 17001476.5 filed Sep. 1, 2017 both of which are hereby incorporated by reference in their entirety.

FIELD OF THE INVENTION

The present invention relates to a support system for mounting medical-technical devices in a clinical environment such as a hospital room or in an intensive care unit.

BACKGROUND OF THE INVENTION

Support systems for medical and technical equipment are routinely used in the clinical field, in particular in hospitals, e.g. operation theatres, and doctor's practices. For example, support systems for monitoring devices or patient terminals are frequently employed for the provision of such devices in the vicinity of a patient's bed. In this regard, various support systems are known in the art, e.g., mounting systems for attachment to a wall or mounting systems for bedside tables.

Depending on the location of the patient's bed, be it in a hospital room, in an intensive care unit, an examination or surgery room, or for transit settings between different locations in a hospital, availability of structures to which such a support system is mountable may vary greatly. If, for example, the patient's bed is located in a hospital room, it may be desirable to attach the support system to a bedside table next to the patient's bed or to a nearby wall. In transit, it would be preferable to attach the support system directly to the patient's bed.

As a result, re-allocation of the devices to be mounted cannot be avoided. If, for example, a mounting system for a patient terminal is installed on a wall in a patient's room, the patient terminal has to be detached from the mounting system and placed on the patient's bed whenever the patient is to be moved to another room. Thus, support systems have to be provided for a plurality of mounting targets with different orientation and geometry, like horizontal and vertical planar surfaces and/or round stock, such as tabletops, bed rails or the like. Furthermore, conventional mounting systems are limited in terms of their adjustment properties referring to position and orientation of the devices to be mounted, such that the required placement of mounted equipment, e.g. monitors or a patient terminal, may be impeded.

In light of the above, it is an object of the present invention to provide a support system that provides a high degree of mounting flexibility as support for technical-medical devices for whatever conditions within clinical environment at low cost and that provides a high degree of flexibility with regard to the positional and orientational adjustment of devices mounted to the support device.

SUMMARY OF THE INVENTION

Specifically, the present invention provides a support system for mounting a medical-technical device in a clinical environment, comprising:

- a fixation unit for mounting the support system in the clinical environment;
- a support module that is attachable to the fixation unit;
- a support arm that comprises a mounting end and an attachment end, wherein the mounting end is mountable to the support module; and
- a joint member that is attachable to the (distal) attachment end of the support arm, that is configured to be attachable to the medical-technical device. The joint member is configured to provide a pivotal connection between the support arm and the medical-technical device.

The fixation unit of the support system according to the present invention allows for a quick and simple mounting of medical-technical devices in various settings or environments of distinct nature. The modular configuration of the support system simplifies reconfiguration of the support system and allows for easy adaptation under whatever mounting conditions. Furthermore, the support system according to the present invention enables easy and highly flexible adjustment of the position and orientation of the device mounted to the support system.

In a preferred embodiment of the invention, the fixation unit is configured as a clamping unit for mounting the support system in a clampable manner. Its technical properties enable simple and flexible mounting of the support system. More preferably, the clamping unit comprises at least one or all of (a) to (e): (a) a clamp body; (b) a first clamp arm and a second clamp arm protruding essentially parallel from the clamp body to essentially form a C-shape; (c) a threaded bore passing through the second clamp arm; (d) a clamp screw retained within the threaded bore; and (e) a clamping element that is movably arranged between the first clamp arm and the second clamp arm, connected to the clamp screw and configured to engage in a clamping manner with the first clamp arm when the clamp screw is screwed into the threaded bore. By such a screw clamp configuration, attachment of the fixation unit to various objects is performed in a straight-forward and advantageous manner.

It is further preferred that the first clamp arm and the clamping element each comprise a clamping surface having a recess. Such recesses preferably extend parallel to each other, and, more preferably, essentially in parallel to the clamp body. With such a configuration, the support system can be securely mounted both to flat surfaces, such as tabletops, and to round stock, such as side rails on a patient bed.

The fixation unit preferably comprises a mounting surface with a plurality of bores, in particular threaded bores, to which the support module is attachable, in particular screwable. If the fixation unit is configured as clamping unit, the mounting surface is preferably formed on the clamp body. Such a construction allows for a simple and reliable attachment of the support module to the fixation unit.

It is further preferred that the support module is attachable to and detachable from the mounting surface in a larger variety of orientations, in particular two orientations that are essentially orthogonal to one another. By such an embodiment, the relative orientation of the fixation unit to the support module can be adapted to allow for mounting of the support system to a support structure by varying their orientation to each other. By rendering the support module attachable to the mounting surface in two orientations that are essentially orthogonal to one another, the support system is configured for being mounted onto horizontal or vertical carrier structures. With only one mounting surface providing different orientations of attachment, reorientation may be facilitated and production costs may be low in comparison to several mounting surfaces, each provided for one attachment orientation.

In a further preferred embodiment of the support system, the support module is attachable to the mounting surface in each of the plurality of orientations with at least two of the plurality of bores, preferably with all of the plurality of bores. Such an arrangement improves the stability of the support system. The support system may thus support greater loads and torques. In particular, damage due to abusive loads, such as a person bracing itself on the support system to climb in a bed, may thus be avoided.

In a further preferred embodiment of the support system, the plurality of orientations is defined by a rotation of the support module relative to the fixation unit around a virtual rotation axis essentially central and essentially orthogonal to the mounting surface, in particular a rotation of about 90°. Such an arrangement allows for easy reorientation of the support module, for example when switching the fixation unit from being clamped to a horizontal carrier structure to being clamped to a carrier structure and vice-versa. In particular, the user does not have to search for a different appropriate location for attaching the support module to the fixation unit. Instead, the support module may be attached to the same mounting surface in a different rotation respectively orientation. Accordingly, the mounting surface and/or the plurality of bores may be configured to provide a variety of attachment orientations, in particular two orientations that are essentially orthogonal to one another.

In a further preferred embodiment of the support system, the plurality of bores are arranged symmetrical with respect to the virtual rotation axis. This may allow the use of several bores or even all of the bores in different attachment orientations of the support module to the fication unit. Accordingly, the number of bores for attachment of the support module to the fixation unit may be reduced even when several attachment orientations are offered. This may reduce production costs and complexity of the parts. Preferably, all bores may be used in every attachment orientation. In particular, if the same mounting surface provides the different attachment orientations, stability of the support system may be high in each orientation while only requiring a low number of bores for attachment.

Preferably, the support module comprises a location hole that is configured to receive the (proximal) mounting end of the support arm. That property simplifies the mounting of the support arm to the support module. It is further preferred that the mounting end of the support arm can be fastened in the location hole, e.g. by providing a threaded fastener or a similar type of fastener in the support module.

The support arm typically comprises a preferably shorter proximal portion that comprises the (proximal) mounting end of the support arm and a (distal) preferably extended (distal) portion that comprises the (distal) attachment end of the support arm. The extended portion of the support arm comprising the attachment end is preferably configured to be swivelable about an axis that essentially extends along the extension direction of the mounting end. That feature of the support arm further improves the alignment capabilities of the support system.

It is further preferred that the support arm comprises a hinge unit that pivotally connects the proximal region of the support arm comprising the mounting end and the distal region of the support arm comprising the attachment end. Such a configuration adds a further degree of freedom for the alignment of a device mounted to the support system. Preferably, the hinge unit comprises a spring mechanism that is configured to balance a torque. The torque is exerted on the hinge unit by the weight of the section of the support arm comprising the attachment end and further members mounted thereto. It is further preferred that the spring mechanism is configured to be adjustable so that the spring force providing the counter-torque can be adjusted according to the weight of the device mounted to the support system. The spring mechanism may allow to balance the support system, thus not requiring a locking system such as screws or clamps to keep the device mounted to the support system in place. In particular, the spring mechanism may allow to move the device mounted to the support system up and down with the hinge with a very low actuation force without requiring disengaging a locking system and afterwards reengaging the locking system for keeping the device mounted to the system in place.

As a further advantage, if the extended portion of the support arm comprising the attachment end is configured to be swivelable about the axis that essentially extends along the extension direction of the mounting end, the supported device may be moved in all directions without requiring engaging and disengaging of a locking device. For that purpose, the support system is preferably arranged so that the axis that essentially extends along the extension direction of the mounting end is essentially orientated vertically. In that case, gravity does not cause unwanted swiveling but rather may only cause slight friction that keeps the support arm in place.

In a further preferred embodiment of the support system, the spring mechanism is connected with a first end to the region that comprises the attachment end of the support arm and with a second end to the region that comprises the mounting end of the support arm. In that case, the spring mechanism automatically swivels with the support arm relative to the support module without requiring any further bearings.

In a further preferred embodiment of the support system, the spring mechanism is connected with a first end to the region that comprises the attachment end of the support arm and with a second end to the support module. In that case, the attachment may be easier since the support module may offer a sturdy construction and more space for connection of the spring mechanism. If the region of the support arm comprising the attachment end is swivelable connected to the support module, as detailed above, the spring mechanism is preferably also swivelable connected to the support module so that both can be swiveled together. This may further ease relocating the device support by the support system. Preferably, the spring mechanism is connected to the support module by means of a circumferential guiding groove or circumferential guiding ring of the support module. This provides a simple and cost-effective bearing structure that also allows to support a sufficiently strong spring mechanism to balance the torque, as detailed above.

Preferably, the spring mechanism is connected to the support module, to the region that comprises the attachment end of the support arm, and/or to the region that comprises the mounting end of the support arm by a guiding structure that allows the respective end of the spring mechanism to slide along at least a part of a length of the support module and/or support arm. This may also provide the means to adjust the counter-torque according to the weight of the device mounted to the support system and additionally or alternatively according to the position of the two ends of the support arm relative to each other due to pivoting around the hinge of the support arm. In particular, the spring mechanism may be configured so that self-adjustment occurs due to a corresponding sliding of at least one of the ends of the spring mechanism if the ends of the support arms are pivoted relatively to each other. In addition, sliding at least one of the ends along the guiding structure may provide means for an easy manual adjustment. The guiding structure may also comprise locking means to fix at least one of the ends of the spring mechanism in place to adjust and/or fix the counter-torque.

The joint member to be attached at the distal end of the support arm preferably comprises a joint, more preferably a ball joint. Thereby, the orientation of a device mounted to the support system can be freely adjusted. The joint member may be configured to be attachable to and detachable form the attached end or may be undetachably fixed thereon. It is further preferred that the joint member comprises locking means configured to lock the joint member in a pivoted position. The stability of the support system is improved by such locking means, especially whenever the support system is used for mounting heavy devices at its distal portion.

BRIEF DESCRIPTION OF THE DRAWINGS

The above and further features and advantages of the invention will become readily apparent from the following detailed description of preferred embodiments of the invention with reference to the accompanying drawings, in which like reference signs designate like features, and in which.

DETAILED DESCRIPTION OF THE INVENTION

Figure 1:
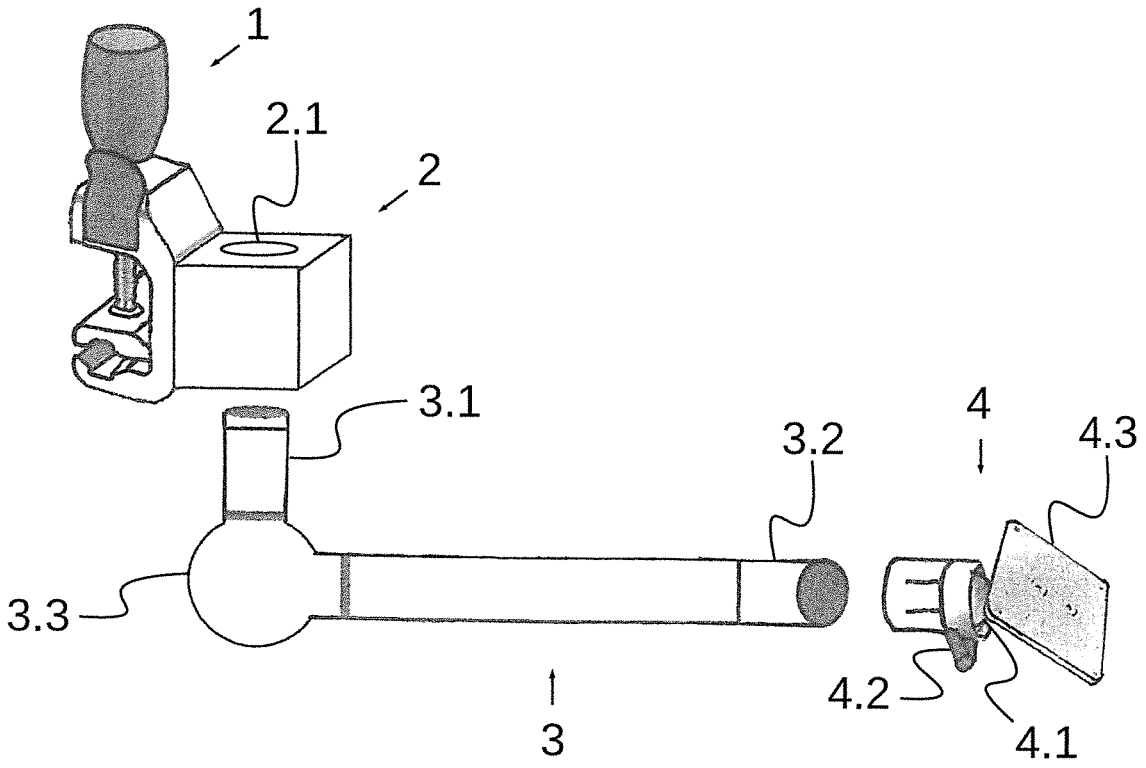
FIG. 1 is a schematic view of a partially assembled support system (A) according to an embodiment of the present invention.

With reference to FIG. 1, a partially assembled support system (A) for mounting a medical-technical device in a clinical environment according to a preferred embodiment of the invention is illustrated. The support system shown in FIG. 1 has a modular design and is essentially composed of (a) a fixation unit 1, (b) a support module 2, (c) a support arm 3 and (d) a joint member 4. Fixation unit 1 is configured to mount the assembled support system onto a carrier structure, e.g. to a component in a clinical environment, such as a planar surface, like a tabletop or a component of a patient bed, such as a side rail. By the present embodiment, fixation unit 1 is configured as a clamping unit, which is designated by the same reference sign in the following. Clamping unit 1 as an embodiment of fixation unit 1 is described in more detail below.

In FIG. 1, support module 2 is attached to fixation unit 1. Support module 2 comprises a location hole 2.1 that is configured to receive the proximal end of support arm 3. That proximal end serves as mounting end 3.1 for mounting the support arm 3 onto or into support module 2. The diameter of the location hole 2.1 typically corresponds to the diameter of the mounting end 3.1 allowing the support arm to be tightly fixed.

The distal end of support arm 3 is provided as attachment end 3.2 that is configured to be connectable to joint member 4. Joint member 4 may be screwed to the attachment end 3.2. Alternatively, joint member 4 may comprise a sleeve-like connection piece that is fitted onto attachment end 3.2 and secured by a marman clamp or the like. Joint member 4 comprises connection means, in the present embodiment connection plate 4.3 with bores, to which a (not shown) technical-medical device, such as a patient terminal, or a monitor or the like is connected or mounted, e.g. by screws or the like.

Joint member 4 further comprises a pivotable connection between connection plate 4.3 and its proximal portion that is connectable to support arm 3. In the present embodiment, the pivotable connection is provided as ball joint 4.1, which allows to freely adjust the orientation of the connection plate 4.3 and, thus, the orientation of a technical-medical device mounted thereto. In order to improve the stability of the pivotable connection, a bracket with a locking handle, is provided as locking means 4.2 to lock the orientation of ball joint 4.1.

Support arm 3 provides two further degrees of freedom for alignment of joint member 4 relative to fixation unit 1 and support module 2. On the one hand, support arm 3 is configured such that its extended portion comprising distal attachment end 3.2 is swivelable around an axis that is defined by the extension direction of the mounting end 3.1. In other words, the extended section of support arm 3 comprising distal attachment end 3.2 can be swiveled in and out of the image plane of FIG. 1.

On the other hand, support arm 3 comprises hinge unit 3.3 from which the extended distal and the shorter proximal portion of support arm 3 protrude. Thereby, the portion of support arm 3 comprising attachment end 3.2 can be pivoted relative to mounting end 3.1. Hinge unit 3.3 may comprise an internal spring mechanism (not shown) that exerts a torque on hinge unit 3.3 such that the extended portion of support arm 3 comprising distal attachment end 3.2 is forced in an upward direction in FIG. 1. The spring mechanism is adjustable so that the generated torque can be adjusted to allow counterbalancing a torque exerted by the weight of support arm 3, joint member 4 and devices mounted thereto. By such a weight compensation mechanism, position and orientation of support arm 3 can be readily altered even when using the inventive support system for mounting heavy devices.

Figure 2:
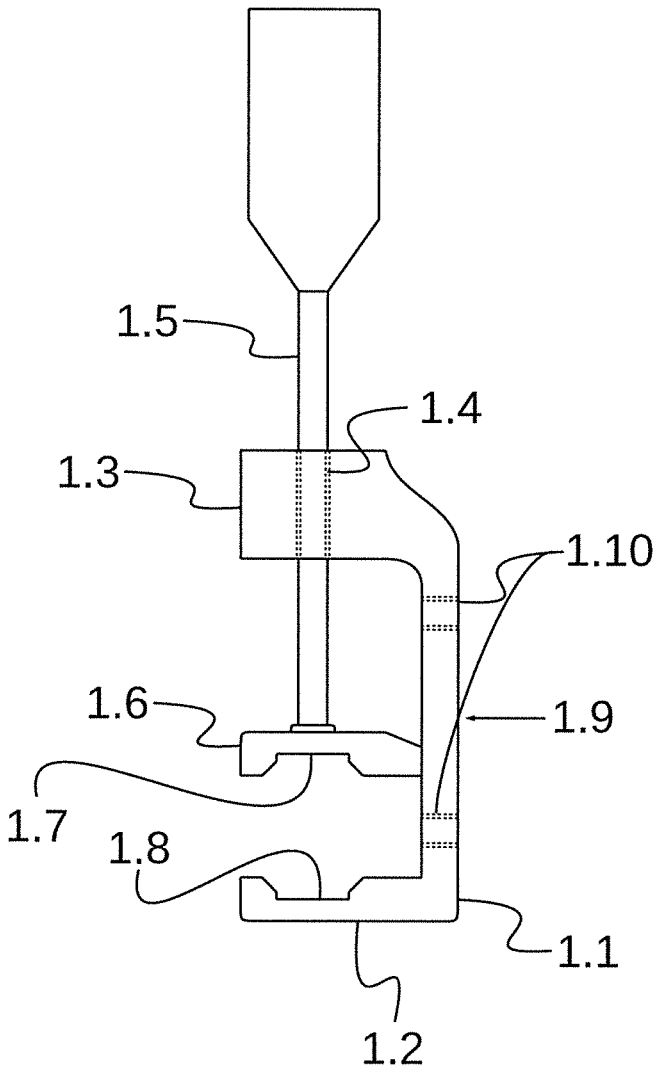
FIG. 2 is a sectional view of a fixation unit according to an embodiment of the present invention.

FIG. 2 shows a sectional view of clamping unit 1 according to the present embodiment of the invention. Clamping unit 1 essentially forms a C-shape that is configured by a vertically extending clamp body 1.1 and two horizontal clamp arms. The first clamp arm 1.2 and the second clamp arm 1.3 protrude essentially parallel and essentially orthogonal from clamp body 1.1.

Second clamp arm 1.3 comprises a threaded bore 1.4 with clamp screw 1.5 retained therein. Clamp screw 1.5 has a clamp screw grip at its upper end that is provided for convenient operation of clamping unit 1. At its lower end, clamp screw 1.5 is connected to clamping element 1.6 that is movably arranged between first clamp arm 1.2 and second clamp arm 1.3. The clamping element 1.6 opposes the first clamp arm 1.2 and provides the clamping function together with first clamp arm 1.2 when clamp screw 1.5 is screwed inwards.

The clamping effect of clamping unit 1 is created between clamping surfaces of clamping element 1.6 and first clamp arm 1.2. The clamping surfaces are the surfaces of clamping element 1.6 and first clamp arm 1.2 opposing each other in FIG. 2. Both clamping surfaces comprise essentially flat areas, so that the clamping unit has a stable grip when attached to flat objects, such as tabletops.

Furthermore, both clamping surfaces comprise a recess 1.7 and 1.8 that extend essentially parallel to each other and are provided to oppose each other. These recesses 1.7 and 1.8 facilitate the mounting of the support system to round stock elements, such as poles or rails. For this, one recess 1.7 is placed against one side of a round stock. The other recess 1.8 will engage with the other side of the round stock when clamp screw 1.5 is screwed into the clamping unit 1. Thus, clamping unit 1 can be secured to any support member with an outer round shape of whatever diameter, any curved surface or any flat surface edge.

The clamping surfaces including recesses 1.7 and 1.8 may be coated with a nonslip material to further improve grip properties of clamping unit 1.

Clamp body 1.1 has a mounting surface 1.9 on an outside face of clamping unit 1 that faces away from or is the opposite to the clamp mechanism described above. The mounting surface 1.9 has bores 1.10 that are provided to enable attachment of support module 2 to clamping unit 1. Support module 2 has correspondingly arranged bores 2.3 on one of its surfaces. For improved stability, a plurality of bores 1.10 is provided.

In order to allow horizontal mounting as well as vertical mounting of the support system with respect to the orientation of whatever available support members (onto which the support system is mounted), the relative orientation of support module 2 to clamping unit 1 is adjustable. Therefore, the arrangement of bores 1.10 and the corresponding arrangement of the bores in the support module exhibits a fourfold rotational symmetry, so that the bore arrangement remains congruent with the original bore arrangement even after rotation by 90°.

As can be taken from FIG. 1 and FIG. 2, the support module 2 can be attached to the clamping unit 1 with several orientations at the same mounting surface 1.9 while using the same bores 1.10. Accordingly, the number of bores 1.10 necessary is low and search for a different mounting surface for reorientation is unnecessary. In particular, this advantage may be provided by the bores 1.10 and the bores 2.3 each being provided with rotational symmetry to a virtual axis that is essentially central and essentially orthogonal to the mounting surfaces 1.9 of the clamping unit 1 and respectively to a corresponding mounting surface of the support module shown in FIG. 2. The virtual axis is indicated in FIG. 2 by crossing of the two dash-dotted that do not pass through the bores 2.3. The support module 2 can easily be re-oriented by unscrewing the screws connecting the support module 2 to the clamping unit 1 with the bores 1.10 and 2.3, rotating the support module 2 by 90° about the virtual axis and screwing the screw into the bores 1.10 and 2.3 again. As is apparent, it is not even necessary to completely remove the screws from either the clamping unit 1 or the support module 2 for this reorientation.

Figure 3A:
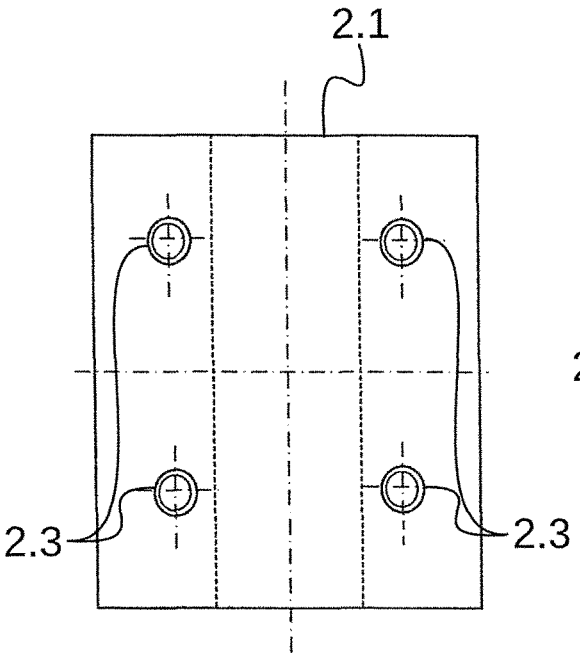
FIG. 3*a-d* are planar views of surfaces of the support module according to an embodiment of the present invention.

An exemplary bore arrangement exhibiting such a property is shown in FIG. 3*a*. A side view of the support module 2 is shown viewed from the side that is connected to the fixation unit 1. Four bores 2.3 are arranged at the edges of a square. Symmetry axes are indicated by dash-dotted lines. If support module 2 is rotated by 90° in the image plane, the bore arrangement is not altered. Thus, support module 2 can be attached to fixation unit 1 in either of these orientations, such that location hole 2.1 and, thus, orientation of support arm 3 with respect to the fixation unit 1 may be rotated by 90° to allow for a mounting of the support system to horizontally and vertically extending support members.

Figure 3B:
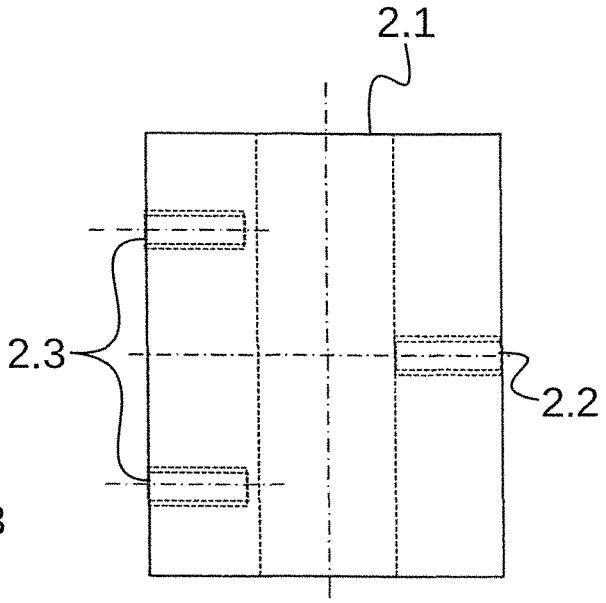
Figure 3C:
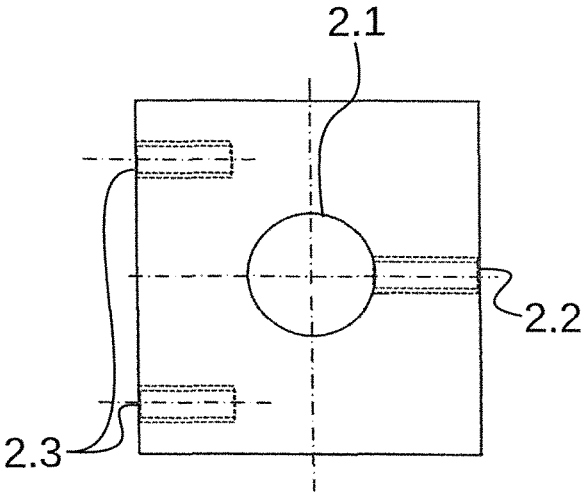
Figure 3D:
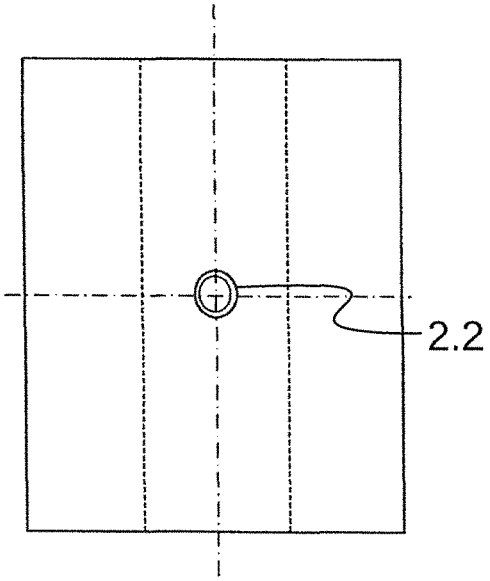

FIG. 3*b* shows a side view of support module 2 viewed from the same direction as in FIG. 1. Bores 2.3 for the attachment to fixation unit 1 are provided on the left side of support module 2. Location hole 2.1 extends through the center of support module 2. From the right side, threaded fixation bore 2.2 is shown that extends from the right side surface of the support module to location hole 2.1. A threaded fastener (not shown) can be accommodated in fixation bore 2.2 and be used to fixate proximal mounting end 3.1 of support arm 3 when it is received in location hole 2.1. FIG. 3*c* shows a top view of support module 2. Location hole 2.1 is shown, as well as the location of fixation bore 2.2 and bores 2.3. FIG. 3*d* is a planar view of the support module's side that is opposite to the side shown in FIG. 3*a*. On this side, only fixation bore 2.2 is shown.

REFERENCE SIGN LIST

A support system
1 fixation unit
1.1 clamp body
1.2 first clamp arm
1.3 second clamp arm
1.4 threaded bore
1.5 clamp screw
1.6 clamping element
1.7 recess
1.8 recess
1.9 mounting surface
1.10 bores
2 support module
2.1 location hole
2.2 fixation bore
2.3 bores
3 support arm
3.1 mounting end
3.2 attachment end
3.3 hinge unit
4 joint member
4.1 ball joint
4.2 locking means
4.3 connection plate

The invention claimed is:

1. A support system for mounting a medical-technical device, comprising:

a fixation unit for mounting the support system on a carrier structure, the fixation unit having a planar mounting surface with a plurality of bores defined therein, the bores each being perpendicular to the planar mounting surface;

a support module attachable to the fixation unit in a plurality of orientations, each of the orientations being rotated with respect to an other of the orientations about an axis perpendicular to the planar mounting surface, the support module being attachable to the fixation unit in each of the orientations using at least two of the plurality of bores in the planar mounting surface;

a support arm comprising a mounting end and an attachment end, the mounting end being mountable to the support module; and a joint member attachable to the attachment end of the support arm, the joint member configured to be attachable to the medical-technical device and to provide a pivotal connection between the support arm and the medical-technical device.

2. The support system according to claim 1, wherein the fixation unit is configured as a clamping unit for mounting the support system in a clampable manner.

3. The support system according to claim 2, wherein the clamping unit comprises:

a clamp body;

a first clamp arm and a second clamp arm protruding substantially parallel from the clamp body to form a C-shaped structure;

a threaded bore passing through the second clamp arm;

a clamp screw retained within the threaded bore;

a clamping element that is movably arranged between the first clamp arm and the second clamp arm, connected to the clamp screw and configured to engage in a clamping manner with the first clamp arm when the clamp screw is screwed into the threaded bore.

4. The support system according to claim 3, wherein the first clamp arm and the clamping element each comprise a clamping surface having a recess.

5. The support system according to claim 1, wherein the support module comprises a location hole configured to receive the mounting end of the support arm.

6. The support system according to claim 5, wherein the location hole extends parallel to the planar mounting surface.

7. The support system according to claim 1, wherein the support arm comprises a region that comprises the mounting end of the support arm and a region that comprises the attachment end of the support arm, and wherein the region of the support arm comprising the attachment end is configured to be swivelable about an axis that essentially extends along the extension direction of the mounting end.

8. The support system according to claim 7, wherein the support arm comprises a hinge unit that pivotally connects the region of the support arm comprising the mounting end and the region of the support arm comprising the attachment end.

9. The support system according to claim 8, wherein the hinge unit comprises a spring mechanism configured to balance a torque exerted on the hinge unit by the weight of the region of the support arm comprising the attachment end and further components mounted thereon.

10. The support system according to claim 9, wherein the spring mechanism is connected to a first end of the region that comprises the attachment end of the support arm and to a second end of the region that comprises the mounting end of the support arm or to the support module, the second end of the spring mechanism being swivelably connected to the support module and the region of the support arm comprising the attachment end being swivelably connected to the support module, by a circumferential guiding groove or circumferential guiding ring of the support module.

11. The support system according to claim 1, wherein the joint member comprises a ball joint, wherein the joint member comprises a locking member configured to lock the joint member in a pivoted position.

12. The support system according to claim 1, wherein the axis about which the support module is rotated is substantially central to the planar mounting surface.

13. The support system according to claim 12, wherein the bores comprise four bores that are arranged symmetrically with respect to the axis about which the support module is rotated such that the plurality of orientations are separated by about 90° and the support module is attachable to the fixation until in each of the orientations by the four bores.

14. The support system according to claim 1, wherein the bores are threaded bores.

15. A support system for mounting a medical-technical device, comprising:

a fixation unit configured as a clamping unit for mounting the support system on a carrier structure, the fixation unit having a planar mounting surface with a plurality of bores defined therein, an axis being defined perpendicular to and substantially central to the planar mounting surface, the bores comprising four bores that are arranged symmetrically with respect to the axis, each bore being perpendicular to the planar mounting surface;

a support module attachable to the fixation unit in a plurality of orientations, each of the orientations being rotated with respect to an other of the orientations by 90° about an axis, the support module being attachable to the fixation unit in each of the orientations using the plurality of bores in the planar mounting surface, the support module further having a location hole defined therein, the location hole extending parallel to the planar mounting surface;

a support arm comprising a mounting end and an attachment end, the mounting end being mountable to the support module; and a joint member attachable to the attachment end of the support arm, the joint member configured to be attachable to the medical-technical device and to provide a pivotal connection between the support arm and the medical-technical device.

* * * * *